US007146783B2

(12) United States Patent
Levsen et al.

(10) Patent No.: US 7,146,783 B2
(45) Date of Patent: Dec. 12, 2006

(54) VACUUM PACKAGING MACHINE

(75) Inventors: Clark A. Levsen, Shawnee, KS (US); Bernard G. Huff, Belton, MO (US)

(73) Assignee: Hantover, Inc., Kansas City, MO (US)

( * ) Notice: Subject to any disclaimer, the term of this patent is extended or adjusted under 35 U.S.C. 154(b) by 81 days.

(21) Appl. No.: 10/907,074

(22) Filed: Mar. 18, 2005

(65) Prior Publication Data

US 2006/0207226 A1 Sep. 21, 2006

(51) Int. Cl.
*B65B 31/00* (2006.01)

(52) U.S. Cl. ..... 53/512; 53/374.9

(58) Field of Classification Search ..... 53/434, 53/510, 512, 374.9
See application file for complete search history.

(56) References Cited

U.S. PATENT DOCUMENTS 4,941,310 A 7/1990 Kristen
5,048,269 A * 9/1991 Deni ..... 53/512
5,239,808 A 8/1993 Wells et al.
5,638,664 A 6/1997 Levsen et al.
5,655,357 A * 8/1997 Kristen ..... 53/512
5,784,862 A * 7/1998 Germano ..... 53/512
5,893,822 A * 4/1999 Deni et al. ..... 53/512
6,256,968 B1 * 7/2001 Kristen ..... 53/512
6,694,710 B1 * 2/2004 Wang ..... 53/512
2005/0034427 A1 2/2005 Hinger et al.

* cited by examiner

*Primary Examiner*—Stephen F. Gerrity
(74) *Attorney, Agent, or Firm*—Hovey Williams LLP

(57) ABSTRACT

A vacuum packaging machine (10) is provided having a base (12) and a pivotally mounted lid (14) which cooperatively define a package air evacuation chamber (76) adapted to receive the open end (98) of a filled flexible package (100), thereby allowing evacuation of air from the package (100) and heat sealing of end (98). The machine (10) is characterized by an essentially flat and uninterrupted, easily cleanable base upper wall (28) which eliminates concavities in the like which can lead to unsanitary collection of fluids or solids. The machine (10) also has a vacuum source (16) and a vacuum conduit assembly (18) the latter having conduits within base (12) and lid (14).

28 Claims, 5 Drawing Sheets

VACUUM PACKAGING MACHINE

CROSS REFERENCE TO RELATED APPLICATION

This application is being filed contemporaneously with application for U.S. Design Pat. Serial No. 29/225,626, filed Mar. 18, 2005, entitled VACUUM PACKAGING MACHINE, which is hereby incorporated by reference herein.

BACKGROUND OF THE INVENTION

1. Field of the Invention

The present invention is broadly concerned with packaging equipment. More particularly, the present invention concerns a vacuum packaging machine of the type used for the purpose of creating evacuated and sealed packages of food.

2. Description of the Prior Art

It is known to provide a vacuum packaging apparatus for use in evacuating the air in an open-ended package and sealing the evacuated package. A typical apparatus of this type presents a chamber sized only for receipt of the open end of the package with the remainder of the package disposed outside of the chamber, and a vacuum pump communicating with the chamber for evacuating the chamber and the package through the open end. The sealing mechanism may include a heating element disposed outside the vacuum chamber and extending along the front of the base beyond the ends of the vacuum chamber. The heating element in this design is fixed to the base so that when the lid is lowered onto the base, the heating element is pressed against a portion of the package external of the chamber. Upon evacuation of the package, current is delivered to the heating element, melting the package material to seal the package closed.

U.S. Pat. No. 5,638,664 discloses an improved packaging apparatus which eliminates the problems inherent in the above types of vacuum packaging devices. The '664 patent has a package sealing element located within a concavity formed in the base, and is entirely within the confines of the evacuation chamber. However, the design also makes use of a liquid trap in the form of an elongated channel rearward of the sealing element, as well as a forward resilient member serving as a part of the vacuum seal. This base design can present problems in that the trap and seal arrangement collects liquids or other food particles and thus can be unsanitary if not cleaned on a regular basis. Furthermore, this patented design employs an elongated inflatable bladder beneath the resistance heating element which is inflated in timed relationship to air evacuation from a package. This bladder is directly coupled with the vacuum pump of the unit and thus is a closed part of the system.

SUMMARY OF THE INVENTION

The present invention provides a greatly improved vacuum packaging apparatus or machine especially designed for household consumer use. With respect to a first aspect of the present invention, the vacuum packaging machine includes a base presenting an upper package end-supporting surface, and a lid operatively coupled with the base and having a lower surface. The lid is movable between an open position permitting placement of the package open end upon the base upper surface, and a closed position where the base upper surface and lid lower surface are in proximity.

The base and lid cooperatively define an evacuation chamber surrounding the package open end when the cover is in the closed position thereof. The machine also includes a vacuum source and an evacuation port in communication with the chamber. The evacuation port is operatively coupled with the vacuum source in order to evacuate the package through the open end. The machine further includes a sealing component proximal to the chamber and operable to seal the open end after evacuation of the package. Moreover, the upper package end-supporting surface of the base in the area thereof bounded by the chamber presents a readily cleanable, essentially flat surface free of concavities. The portion of the base within the confines of the evacuation chamber is consequently substantially flat and uninterrupted, and free of slots or other concavities which can collect fluids or solid food particles and lead to unsanitary conditions. That portion of the base can simply be cleaned by wiping it with a cloth (preferably utilizing also a sanitary cleaning fluid).

Another aspect of the present invention concerns a vacuum packaging machine including a base and a lid operatively coupled with the base. The lid is movable between an open position permitting placement of the package open end between the lid and base, and a closed position where the lid and base are in proximity. The base and lid cooperatively define an evacuation chamber surrounding the package open end when the cover is in the closed position thereof. A vacuum source is provided within said base, and an evacuation port in the lid is in communication with the chamber. The machine further includes a sealing component proximal to the chamber and operable to seal the open end after evacuation of the package. Yet further, the machine includes a conduit assembly operatively coupling the evacuation port with the vacuum source in order to evacuate the package through the open end. The conduit assembly includes a first conduit extending from the evacuation port to a connection port on the lid outside the boundaries of the chamber, a second conduit within the base extending from a connection port on the base outside the confines of the chamber and coupled with the vacuum source, and sealing structure between the lid and base connection ports affording a seal between the connection ports when the lid is in the closed position thereof.

A third aspect of the present invention concerns a vacuum packaging machine including a base and a lid operatively coupled with the base. The lid is movable between an open position permitting placement of the package open end between the lid and base, and a closed position where the lid and base are in proximity. The base and lid cooperatively define an evacuation chamber surrounding the package open end when the cover is in the closed position thereof. The machine also includes a vacuum source, as well as an evacuation port in communication with the chamber and operatively coupled with the vacuum source in order to evacuate the package through the open end. The machine further includes a sealing component proximal to the chamber and operable to seal the package open end after evacuation of the package. The sealing component includes an elongated expandable bladder having the interior thereof vented to the atmosphere, and a resistance heatable sealing element disposed above the bladder. The base presenting a housing in which the bladder is located, and the vacuum source is operatively coupled with the housing for inducing negative pressure conditions therein. The bladder is operable, under the influence of induced negative pressure conditions within the housing, to expand and shift the sealing element towards the chamber for sealing of the package open end.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

DETAILED DESCRIPTION OF THE PREFERRED EMBODIMENT

Figure 1:
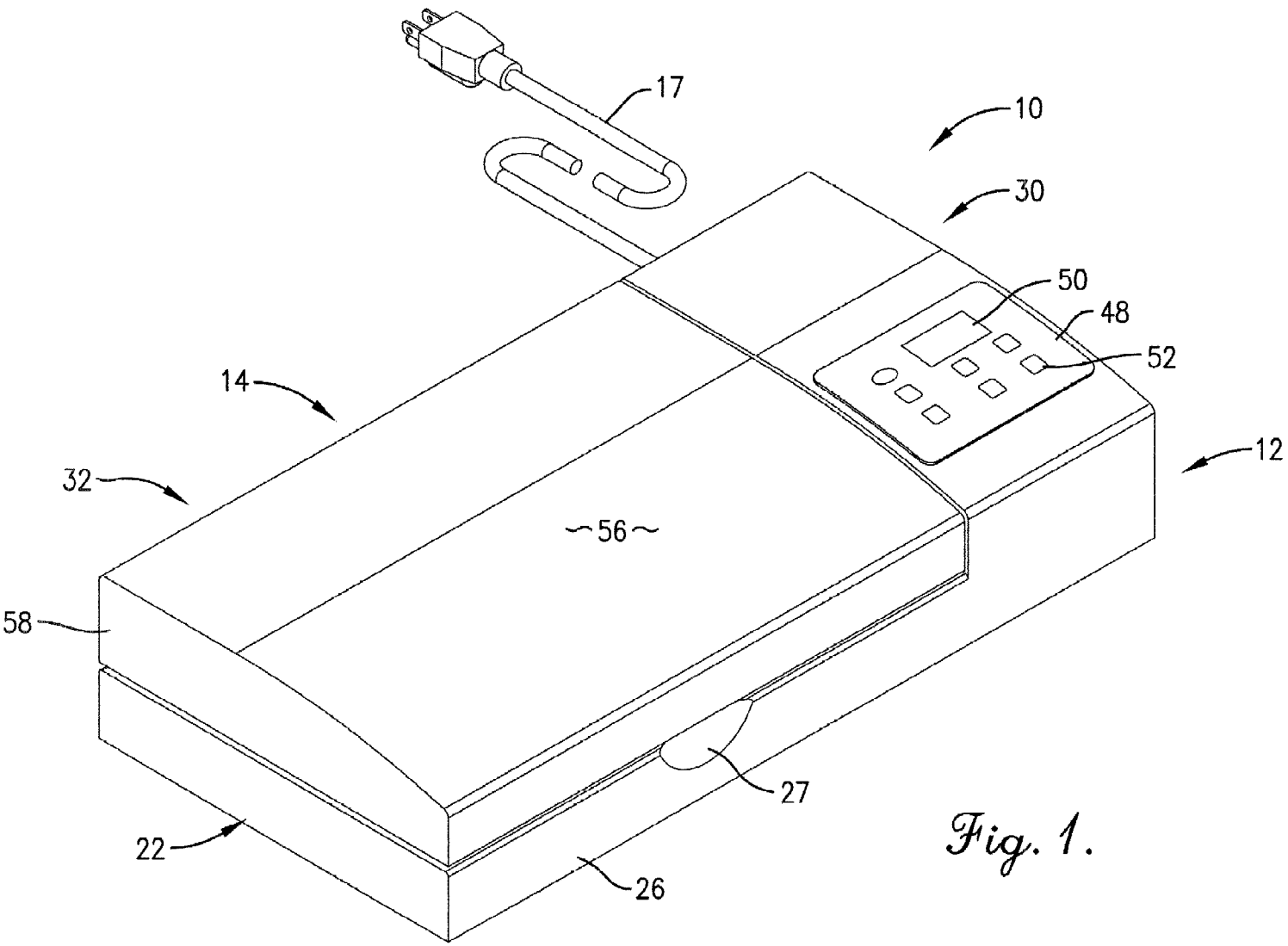
FIG. 1 is a perspective view of a vacuum packaging machine in accordance with the invention.
Figure 2:
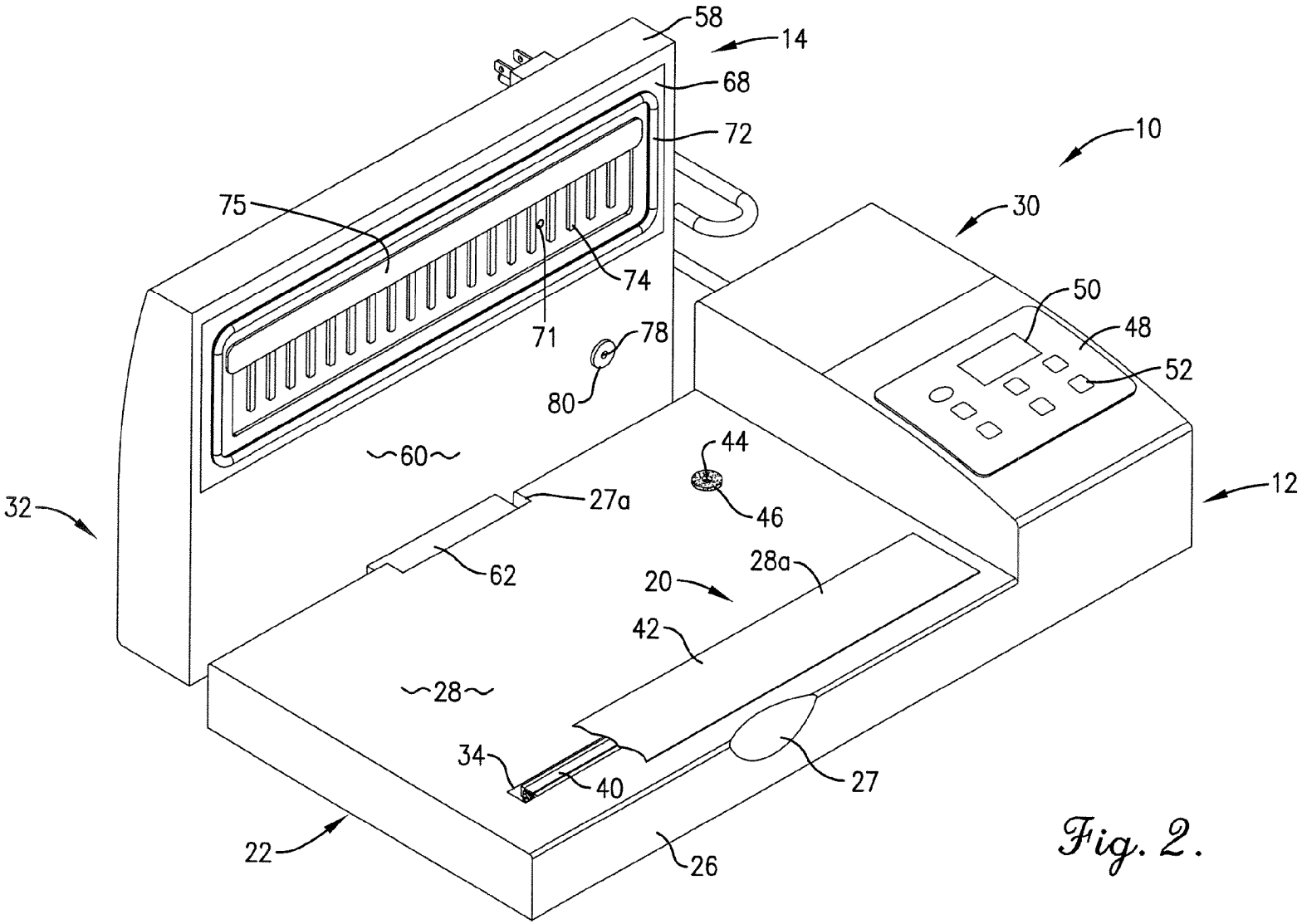
FIG. 2 is a perspective view similar to that of FIG. 1, but depicting the lid of the machine in its open position.

Turning now to the drawings, and particularly FIGS. 1 and 2, a vacuum packaging machine 10 in accordance with the invention broadly includes a base 12 and a lid 14 pivotally coupled to the base and shiftable between a closed position (FIG. 1) and an open position (FIG. 2). The overall machine 10 further includes a vacuum source 16 within base 12, a conduit assembly 18 having components within base 12 and lid 14, and a package sealing assembly 20 supported by base 12 and lid 14.

Figure 4:
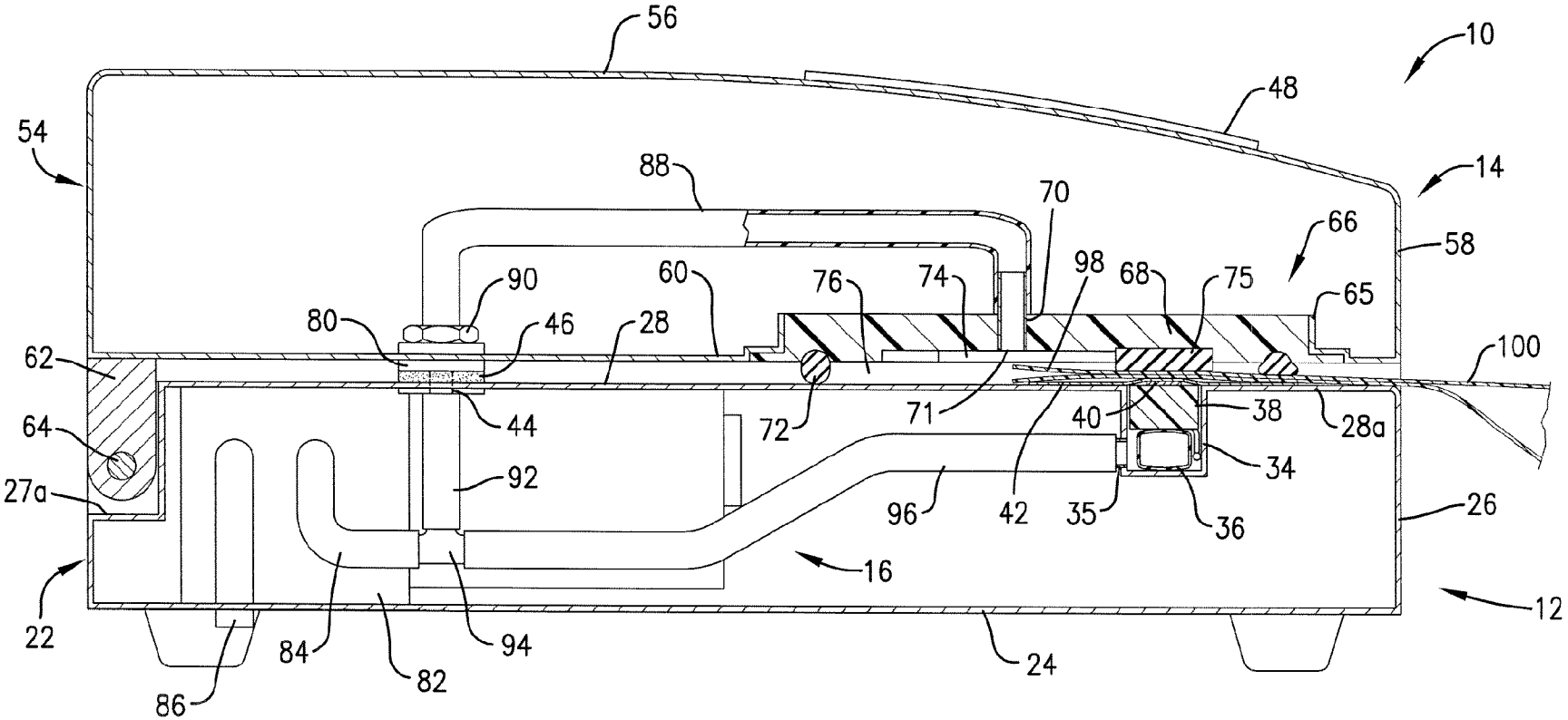
FIG. 4 is a vertical sectional view similar to that of FIG. 3, but showing the machine in use during evacuation and sealing of a package.

In more detail, the base 12 is in the form of a housing 22 including a bottom wall 24, circumscribing sidewalls 26 formed to present a forward access notch 27 and a rearward, central, lid-mounting recess 27*a*, and an upper, smooth and substantially uninterrupted top wall 28. The top wall preferably presents a package end-supporting surface 28*a* that serves to support the open end of the package during the evacuation and sealing steps. The housing 22 has a vacuum pump and control section 30 astride the lidded package evacuated and sealing section 32. Referring to FIG. 4, it will be observed that projecting downwardly from the top wall 28 is an elongated, laterally extending, rectangular in cross-section bladder housing 34. The housing presents a tubular vacuum conduit insert 35 and a venting outlet 35*a* (see FIG. 5).

The package sealing assembly 20 preferably includes an elongated resilient elastomeric bladder 36 seated within housing 34 with venting outlet 35*a* extending through the housing wall and into the interior of the bladder to vent bladder 36 to the atmosphere. A sponge-like, closed cell elongated sealing member 38 is located atop bladder 36. Although the sealing member 38 is illustrated within the bladder housing 36, the principles of the present invention are equally applicable to a arrangement wherein only the bladder is sealed within the housing (for purposes which will be described) but maintains its operable connection to the sealing member 38 to control movement thereof. An elongated resistance heatable package end sealing element 40 rests on the member 38, and is preferably secured thereto by suitable means (such as fasteners, adhesive, etc.). It will be appreciated that a number of the components of the illustrated embodiment are similar to those disclosed in U.S. Pat. No. 5,638,664, which is hereby incorporated by reference herein as is necessary for a full and complete understanding of the present invention.

The top wall 28 of the base 12 further includes an elongated strip 42 of flexible resilient material surmounting and covering the upper open end of bladder housing 34 and the components therein. The strip 42 may be formed of TEFLON® or other suitable material, and is adhesively secured in place in order to affect a seal over the housing while substantially maintaining the continuous and uninterrupted nature of top wall 28. The strip is sufficiently flexible to permit movement of the sealing member (and element 40), as well as being sufficiently conductive to transfer heat from the element 40 to the package, when sealing of the package is affected. The top wall 28 also includes a rearward connection port 44 surrounded by a resilient annular gasket-type sealing member 46; the importance of this port and seal arrangement will be made clear hereinafter.

The housing section 30 includes a control panel 48 having a readout 50 and appropriate control buttons 52 to initiate and control the operation of the machine 10.

Lid 14 is fabricated in the form of a housing 54 having top wall 56, circumscribing sidewalls 58 and bottom wall 60. A central, depending, rearmost extension 62 is secured to the housing 54 and is received within base recess 27*a*. A pivot pin 64 connected to the base serves to pivotally mount the lid 14 to base 12.

The bottom wall 60 of lid housing 54 has a rectangular stepped opening 65 therein which receives an evacuation and sealing assembly 66. The assembly forms part of the package sealing assembly 20 and cooperates with the above-noted components in the base 12 to seal the package, as will be described. More particularly, the assembly 66 includes an apertured synthetic resin plate 68 having a tubular insert 70 aligned with an evacuation port 71. The lower surface of plate 68 supports a generally rectangular, circumscribing resilient sealing element 72 as well as inboard, elongated, laterally spaced ribs 74. The purpose of element 72 and ribs 74 is to form closed evacuation chamber 76 (see FIG. 4) when lid 14 is closed. Finally, an elongated, resilient backing strip 75 is supported on plate 68 and is adapted to come into registry with resistance sealing element 40 when lid 14 is closed.

The bottom wall 60 also has a connection port 78 therein with a rigid, annular gasket-type sealing member 80 disposed about and in registry with connection port. The port 78 is located to mate with base connection port 44 when the lid 14 is closed, and with the annular seals 46 and 80 also in sealing engagement with another. This unique arrangement provides the necessary communication between the evacuation port 71, which is preferably located within the lid 14, and the vacuum source 16, which is preferably located within the base. It will be appreciated, that the sealing arrangement between the connection ports 44 and 78 could also accommodate a design in which locations of the evacuation port and vacuum source are reversed, with the former being in the base and latter being in the lid.

The vacuum source 16 is preferably a conventional vacuum pump 82 having a vacuum output conduit 84 and an exhaust conduit 86 vented to the atmosphere through the bottom wall 24. As noted previously, the pump 62 is preferably housed within section 30 of base 12, generally below and rearward of control panel 48.

Figure 3:
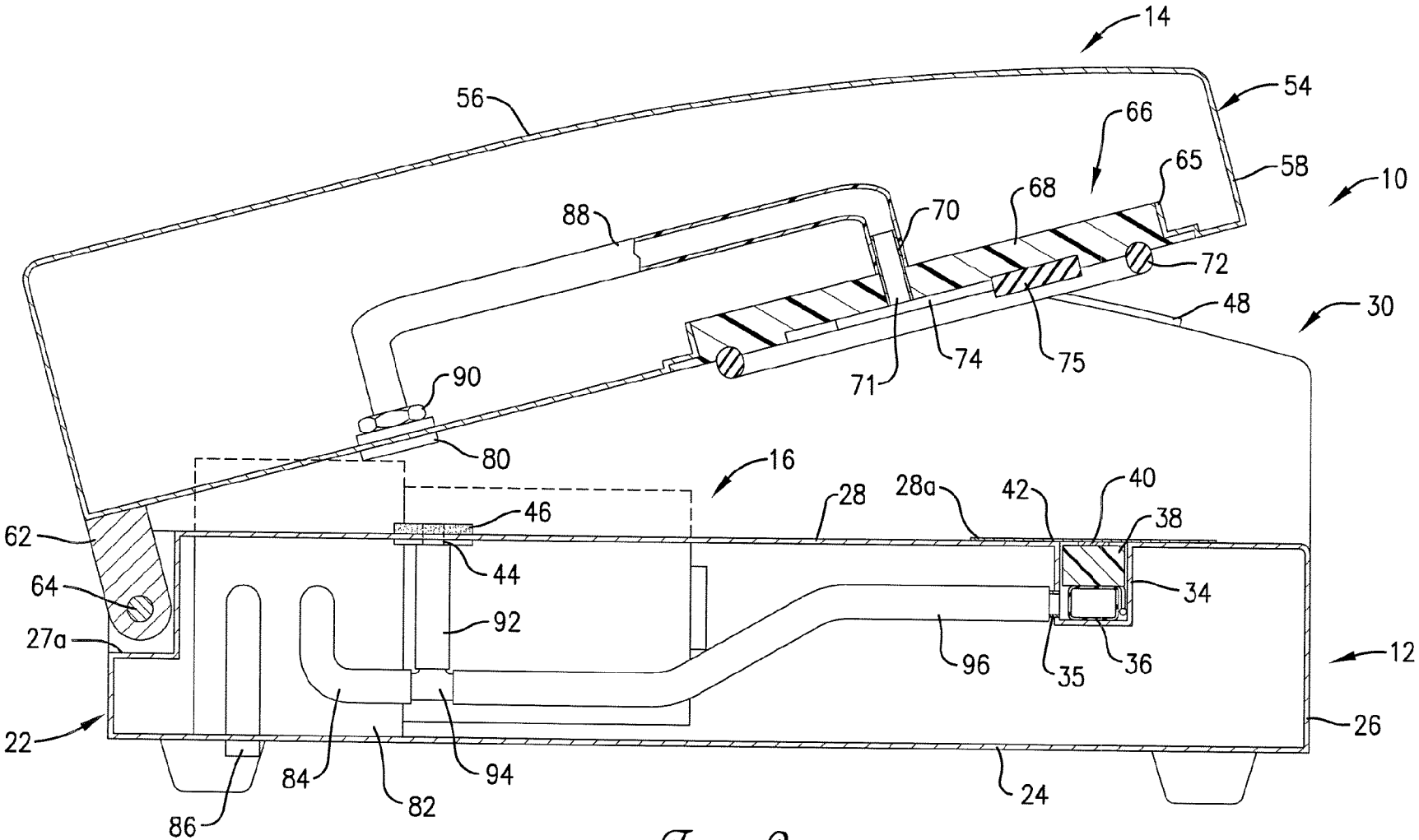
FIG. 3 is a vertical sectional view of the vacuum packaging machine illustrating the lid in a partially opened condition and depicting the internal details of construction of the machine.
Figure 5:
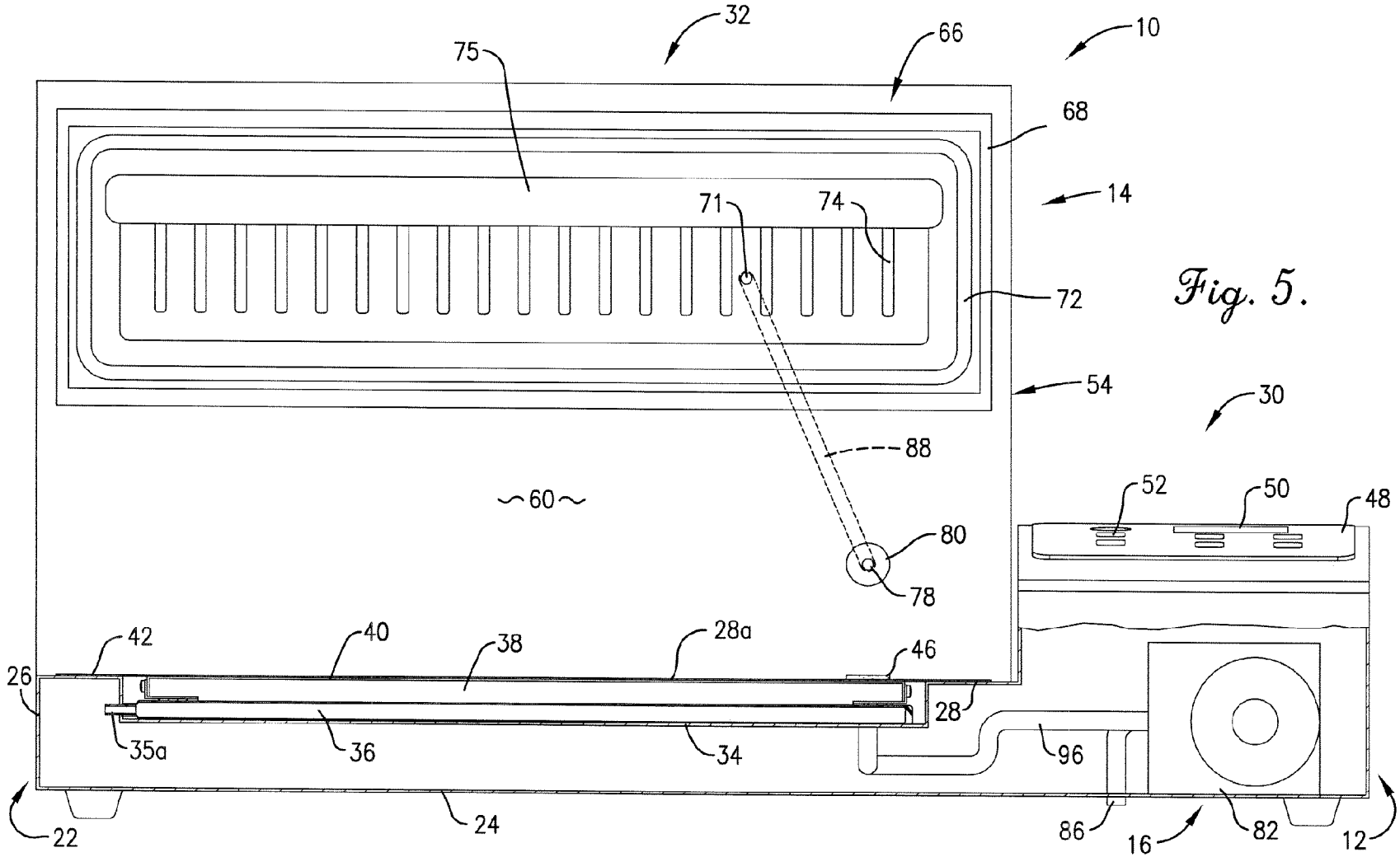
FIG. 5 is a front view of the vacuum packaging machine with certain parts broken away and other parts illustrated in phantom.

The conduit assembly 18 includes a first, generally U-shaped conduit 88 within housing 54 of lid 14. As best seen in FIGS. 3–5, the conduit 88 is secured to insert 70 at one end thereof, and is connected at the other end in mating relationship with connection port 78 via coupler 90. The overall assembly 18 further includes conduits within base housing 22, namely a second, depending conduit 92 secured to the underside of wall 28 in registry with connection port 44 and having a T-coupler 94 at the lower end thereof. One leg of T-coupler 94 is connected to vacuum pump conduit 84. The other leg is connected with a third conduit 96 which is secured to insert 35 to communicate with the interior of bladder housing 34.

As shown in FIG. 1, the machine 10 is provided with an electrical cord 97 for connecting to a conventional wall socket (not shown) to provide power to the various electrical components. It will be appreciated, however, that the principles of the present invention are equally applicable to a battery-powered machine or a machine utilizing other suitable sources for powering the necessary components.

In the use of machine 10, lid 14 is first opened, exposing the upper package end-supporting surface 28*a* defined by base top wall 28. Next, the user places the open end 98 of a flexible bag or package 100 (see FIG. 4) on the surface 28*a* generally above sealing element 40, with the end 98 preferably being within the confines of the chamber 76 (i.e., within the area bounded by the element 72). The lid 14 is then closed, with sealing element 72 coming into engagement with top wall 28 and the upper ply of end 98 in order to create a substantially air tight evacuation chamber 76. Moreover, closure of the lid 14 causes the annular sealing elements 80 and 44 to come into sealing engagement, thus communicating the connection ports 44 and 78 which are of course well outside the boundaries of chamber 76. Furthermore, with closure of the lid 14, the backing member 75 comes into registry with sealing element 40 beneath strip 42.

Next, the control buttons 52 are manipulated in order to first evacuate air from package 100 and then to seal the open end 98. Alternatively, these steps may be automatically initiated by the panel 48 whenever the lid 14 is closed. In either case, the vacuum pump 82 is operated which first serves to evacuate air from package 100. The pump 82 exhausts the air from the package through port 71, insert 70, first conduit 88, connection ports 78, 44, second conduit 90, vacuum conduit 84 and exhaust conduit 86. During this same time, a vacuum is drawn in third conduit 96 and thereby the bladder housing 34. Because the interior of the bladder is vented to atmosphere, the negative pressure created within the housing 34 by the pump 82 serves to expand bladder 36. It has been determined that the illustrated embodiment advantageously ensures that bladder expansion proceeds relatively slowly as compared with evacuation of package 100, and thus the bladder expansion does not impede the desired package air evacuation. However, if necessary, the conduit assembly 18 may be provided with a flow restrictor or valve (both not shown) within the third conduit 96 to ensure such operational timing.

After a predetermined time of vacuum pump operation calculated to remove substantially all air from package 100 while effecting vacuum induced expansion of bladder 36, the formerly open end 98 of package 100 is closed. At this point the resistance heating element 40 is energized, quickly developing sufficient heat to fuse the plies of open end 98, thus sealing the package 100. The backing strip 75 ensures sufficient engagement (through the strip 42) between the element 40 and package 100 to provide the desired sealing of the open end 98. After such sealing, the lid 14 is again opened, and the evacuated and sealed package is removed.

A particular feature of the construction of machine 10 resides in provision of an essentially flat, continuous sealing surface 28 defined by part of the illustrated top wall 28, which is entirely free of concavities or other surface features which collect fluids or solids. Thus, this upper surface is readily cleanable and more sanitary.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A vacuum packaging machine for evacuating and sealing the open end of a package, said vacuum packaging machine comprising:

a base presenting an upper package end-supporting surface;

a lid operatively coupled with the base and having a lower surface, said lid movable between an open position permitting placement of the package open end upon said base upper surface, and a closed position where said base upper surface and lid lower surface are in proximity, said base and lid cooperatively defining an evacuation chamber surrounding the package open end when said cover is in said closed position thereof;

a vacuum source;

an evacuation port in communication with said chamber and operatively coupled with said source in order to evacuate the package through the open end; and a sealing component proximal to said chamber and operable to seal the open end after said evacuation, said upper package end-supporting surface of said base in the area thereof bounded by said chamber presenting a readily cleanable, essentially flat surface free of concavities.

2. The vacuum packaging machine as claimed in claim 1, said evacuation port formed in said lid; and a conduit assembly disposed at least in part within said lid and operatively coupling the evacuation port with said vacuum source.

3. The vacuum packaging machine as claimed in claim 2, said vacuum source comprising a vacuum pump within said base, said conduit assembly including a first conduit within said lid extending from said evacuation port to a connection port on the lid outside of the boundaries of said chamber, a second conduit within said base extending from a connection port on said base outside the confines of said chamber and coupled with said pump, and sealing structure between said lid and base connection ports affording a seal between the connection ports when said lid is in the closed position thereof.

4. The vacuum packaging machine as claimed in claim 3, said sealing structure comprising a resilient annular seal carried by one of said base and lid and surrounding the respective connection port, and a rigid annular seal carried by the other of said base and lid and surrounding the respective connection port, said rigid seal sealingly engageable with said resilient seal when said lid is moved to the closed position thereof.

5. The vacuum packaging machine as claimed in claim 3, said base presenting a top wall, at least part of which defines the package end-supporting surface, said top wall being essentially flat and free of concavities except for the connection port on the base.

6. The vacuum packaging machine as claimed in claim 3, said sealing component comprising a resistance heatable sealing element and a pneumatically expandable bladder located beneath the sealing element, said element located beneath said base upper surface and shiftable into a sealing position under the influence of the bladder, said base presenting a bladder housing in which the bladder is located, said conduit assembly including a third conduit operatively coupling said housing and said vacuum pump.

7. The vacuum packaging machine as claimed in claim 6, said bladder presenting an interior that is vented to the atmosphere such that vacuum pressure supplied by the vacuum pump via the third conduit causes the bladder to expand.

8. The vacuum packaging machine as claimed in claim 6, said sealing element being located within the bladder housing, said bladder housing projecting downwardly from the package end-supporting surface of the base, said package end-supporting surface including a flexible, heat conductive strip that covers the bladder housing and forms in part the flat surface.

9. The vacuum packaging machine as claimed in claim 1, said lid including a continuous, resilient, chamber sealing member adjacent the lower lid surface, said sealing member engageable with said base upper surface when said lid is in the closed position thereof in order to define said chamber.

10. The vacuum packaging machine as claimed in claim 1, said sealing component comprising a resistance heatable sealing element and a pneumatically expandable bladder located beneath the sealing element, said element located beneath said base upper surface and shiftable into a sealing position under the influence of the bladder, said base presenting a bladder housing in which the bladder is located; and a conduit operatively coupling said housing and said vacuum source.

11. The vacuum packaging machine as claimed in claim 10, said bladder presenting an interior that is vented to the atmosphere such that vacuum pressure supplied by the vacuum source via the conduit causes the bladder to expand.

12. The vacuum packaging machine as claimed in claim 10, said sealing element being located within the bladder housing, said bladder housing projecting downwardly from the package end-supporting surface of the base, said package end-supporting surface including a flexible, heat conductive strip that covers the bladder housing and forms in part the flat surface.

13. A vacuum packaging machine for evacuating and sealing the open end of a package, said vacuum packaging machine comprising:

a base;

a lid operatively coupled with the base and movable between an open position permitting placement of the package open end between the lid and base, and a closed position where the lid and base are in proximity, said base and lid cooperatively defining an evacuation chamber surrounding the package open end when said cover is in said closed position thereof;

a vacuum source within said base;

an evacuation port in said lid in communication with said chamber;

a sealing component proximal to said chamber and operable to seal the open end after evacuation of the package; and a conduit assembly operatively coupling the evacuation port with the vacuum source in order to evacuate the package through the open end, said conduit assembly including a first conduit extending from said evacuation port to a connection port on the lid outside the boundaries of said chamber, a second conduit within the base extending from a connection port on said base outside the confines of said chamber and coupled with said source, and sealing structure between said lid and base connection ports affording a seal between the connection ports when said lid is in the closed position thereof.

14. The vacuum packaging machine as claimed in claim 13, said vacuum source comprising a vacuum pump.

15. The vacuum packaging machine as claimed in claim 13, said sealing structure comprising a resilient annular seal carried by one of said base and lid and surrounding the respective connection port, and a rigid annular seal carried by the other of said base and lid and surrounding the respective connection port, said rigid seal sealingly engageable with said resilient seal when said lid is moved to the closed position thereof.

16. The vacuum packaging machine as claimed in claim 13, said base presenting a top wall, at least part of which defines a package end-supporting surface upon which the package open end is placed during evacuation and sealing of the package, said top wall being essentially flat and free of concavities except for the connection port on the base.

17. The vacuum packaging machine as claimed in claim 13, said sealing component comprising a resistance heatable sealing element and a pneumatically expandable bladder located beneath the sealing element, said element being shiftable into a sealing position under the influence of the bladder, said base presenting a bladder housing in which the bladder is located, said conduit assembly including a third conduit operatively coupling said housing and said vacuum source.

18. The vacuum packaging machine as claimed in claim 17, said bladder presenting an interior that is vented to the atmosphere such that vacuum pressure supplied by the vacuum source via the third conduit causes the bladder to expand.

19. The vacuum packaging machine as claimed in claim 17, said sealing element being located within the bladder housing, said base presenting a package end-supporting surface upon which the package open end is placed during evacuation and sealing of the package, said bladder housing projecting downwardly from the package end-supporting surface of the base, said package end-supporting surface including a flexible, heat conductive strip that covers the bladder housing.

20. The vacuum packaging machine as claimed in claim 13, said lid including a continuous, resilient, chamber sealing member that is engageable with said base when said lid is in the closed position thereof in order to define said chamber.

21. A vacuum packaging machine for evacuating and sealing the open end of a package, said vacuum packaging machine comprising:

a base;

a lid operatively coupled with the base and movable between an open position permitting placement of the package open end between the lid and base, and a closed position where the lid and base are in proximity, said base and lid cooperatively defining an evacuation chamber surrounding the package open end when said cover is in said closed position thereof;

a vacuum source;

an evacuation port in communication with said chamber and operatively coupled with said source in order to evacuate the package through the package open end; and a sealing component proximal to said chamber and operable to seal the package open end after said evacuation, said sealing component including an elongated expandable bladder having the interior thereof vented to the atmosphere, and a resistance heatable sealing element disposed above said bladder, said base presenting a housing in which the bladder is located, said vacuum source operatively coupled with said housing for inducing negative pressure conditions therein, said bladder operable, under the influence of induced negative pressure conditions within said housing, to expand and shift said sealing element towards said chamber for sealing of the package open end.

22. The vacuum packaging machine as claimed in 21, said sealing component including an elongated resilient spacer body located between said bladder and said sealing element.

23. The vacuum packaging machine as claimed in claim 21, said evacuation port formed in said lid; and a conduit assembly disposed at least in part within said lid and operatively coupling the evacuation port with said vacuum source.

24. The vacuum packaging machine as claimed in claim 23, said vacuum source comprising a vacuum pump within said base, said conduit assembly including a first conduit within said lid extending from said evacuation port to a connection port on the lid outside of the boundaries of said chamber, a second conduit within said base extending from a connection port on said base outside the confines of said chamber and coupled with said pump, and sealing structure between said lid and base connection ports affording a seal between the connection ports when said lid is in the closed position thereof.

25. The vacuum packaging machine as claimed in claim 24, said sealing structure comprising a resilient annular seal carried by one of said base and lid and surrounding the respective connection port, and a rigid annular seal carried by the other of said base and lid and surrounding the respective connection port, said rigid seal sealingly engageable with said resilient seal when said lid is moved to the closed position thereof.

26. The vacuum packaging machine as claimed in claim 24, said base presenting a top wall, at least part of which defines a package end-supporting surface upon which the package open end is placed during evacuation and sealing of the package, said top wall being essentially flat and free of concavities except for the connection port on the base.

27. The vacuum packaging machine as claimed in claim 21, said sealing element being located within the housing, said base presenting a package end-supporting surface upon which the package open end is placed during evacuation and sealing of the package, said housing projecting downwardly from the package end-supporting surface of the base, said package end-supporting surface including a flexible, heat conductive strip that covers the housing.

28. The vacuum packaging machine as claimed in claim 21, said lid including a continuous, resilient, chamber sealing member that is engageable with said base when said lid is in the closed position thereof in order to define said chamber.

* * * * *